United States Patent [19]

Reist

[11] Patent Number: 4,595,192

[45] Date of Patent: Jun. 17, 1986

[54] METHOD AND APPARATUS FOR PROCESSING SUBSTANTIALLY FLAT PRODUCTS, ESPECIALLY PRINTED PRODUCTS, UNWOUND FROM A STORAGE COIL OR PACKAGE

[75] Inventor: Walter Reist, Hinwil, Switzerland

[73] Assignee: Ferag AG, Hinwil, Switzerland

[21] Appl. No.: 644,793

[22] Filed: Aug. 27, 1984

[30] Foreign Application Priority Data

Sep. 5, 1983 [CH] Switzerland ..... 4858/83

[51] Int. Cl.[4] ..... B65H 29/66; B65H 29/36; B65H 5/24

[52] U.S. Cl. ..... 271/184; 271/225; 271/902; 242/59

[58] Field of Search ..... 271/184, 185, 186, 216, 271/225, 307, 308, 902, 237, 151, 202, 203, 212; 414/29; 198/457, 406, 461, 462, 459, 423; 83/88; 242/59

[56] References Cited

U.S. PATENT DOCUMENTS

| | | | |
|---|---|---|---|
| 3,827,545 | 8/1974 | Buhayar | 198/461 |
| 4,135,616 | 1/1979 | Pellaton | 271/216 X |
| 4,218,743 | 7/1980 | Meier | 271/184 X |
| 4,438,618 | 3/1984 | Honegger | 414/29 X |

FOREIGN PATENT DOCUMENTS 1272310 12/1963 Fed. Rep. of Germany .

*Primary Examiner*—Bruce H. Stoner, Jr.
*Assistant Examiner*—Lawrence J. Goffney, Jr.
*Attorney, Agent, or Firm*—Werner W. Kleeman

[57] ABSTRACT

The printed products unwound from a storage coil or wound package in imbricated product formation are conveyed over two belt conveyors against a stop. According to one embodiment the printed products are separated from the imbricated product formation before reaching the end of the first conveyor device formed by the two belt conveyors by an acceleration imposed by the second of the two belt conveyors, i.e. they are singled. According to another embodiment the imbrication of the printed products is inverted before the products reach the end of the first conveyor device. The individual printed products fall downward after impinging the stop and are deposited upon the preceding printed product in an imbricated formation. The imbricated product formation is conveyed away by a belt conveyor of a second conveyor device in a conveying direction opposite to the conveying direction of the first conveyor device. A new imbricated product formation is therefore formed upon the last-mentioned belt conveyor within which the printed products assume the same mutual orientation as they had before being wound up upon the storage coil.

18 Claims, 4 Drawing Figures

METHOD AND APPARATUS FOR PROCESSING SUBSTANTIALLY FLAT PRODUCTS, ESPECIALLY PRINTED PRODUCTS, UNWOUND FROM A STORAGE COIL OR PACKAGE

BACKGROUND OF THE INVENTION

The present invention broadly relates to the processing of substantially flat products and, more specifically, pertains to a new and improved method and apparatus for processing substantially flat products, especially printed products, unwound from a storage coil or package in imbricated product formation.

From the German Patent Publication No. 3,123,888 and the corresponding British Patent Publication No. 2,801,230, both corresponding to the U.S. Pat. No. 4,438,618, issued Mar. 27, 1984, it is known to wind up the output of a rotary printing press or rotogravure machine arriving in an imbricated product formation for intermediate storage before further processing. In the imbricated product formation later unwound from this storage coil or wound package, the printed products assume a different mutual orientation than in the originally arriving imbricated product formation, i.e. after unwinding the edges of the printed products which were leading edges in the original imbricated product formation become trailing edges. The further processing of the imbricated product formation unwound from the storage coil or wound package is, for this reason, not entirely unproblematic. It is in many cases requisite for further processing that the printed products assume their original mutual orientation within the imbricated product formation.

From the German Patent Publication No. 3,151,860 and the corresponding British Patent Publication No. 2,902,557, both corresponding to the copending, commonly assigned U.S. patent application Ser. No. 06/338,568, filed Jan. 11, 1982, an apparatus is known in which the printed products unwound in imbricated product formation from a first coil or package are wound up upon a second coil or package. In the imbricated product formation subsequently unwound from this second coil, the printed products assume a mutual orientation which corresponds to the orientation of the printed products in the original imbricated product formation. With this known apparatus the requirement can therefore be fulfilled that after intermediate storage of the printed products in a coil or wound package and the subsequent unwinding thereof, the printed products within the imbricated product formation assume their original mutual orientation. However, considerable construction outlay is necessary. Furthermore, the processing time is increased which is undesirable in certain cases.

SUMMARY OF THE INVENTION

Therefore, with the foregoing in mind, it is a primary object of the present invention to provide a new and improved method and apparatus for processing substantially flat products, especially printed products, unwound from a storage coil or package which does not exhibit the aforementioned drawbacks and shortcomings of the prior art constructions.

Another and more specific object of the present invention aims at providing a new and improved method and apparatus for processing substantially flat products, especially printed products, unwound from a storage coil or package of the previously mentioned type which permit conducting the flat products, after intermediate storage upon the coil, to a processing station in the orientation requisite for unhindered further processing with as little equipment construction outlay as possible.

Yet a further significant object of the present invention aims at providing a new and improved method and apparatus for processing substantially flat products, especially printed products, unwound from a storage coil, which method and apparatus are relatively simple in concept, extremely economical to realize, highly reliable in operation, not readily subject to malfunction and require a minimum of attention.

Now in order to implement these and still further objects of the invention, which will become more readily apparent as the description proceeds, the method of the present invention is manifested by the features that it comprises the steps of depositing individual ones of the unwound flat products at the end of a first conveying path and moving in a first conveying direction in imbricated product formation upon preceding ones of the unwound flat products which are moving in a second conveying direction substantially opposite to the first conveying direction along a second conveying path arranged substantially beneath the first conveying path.

The apparatus of the present invention is manifested by the features that it comprises second conveyor means arranged substantially beneath first conveyor means for taking over the unwound flat products individually from the first conveyor means. The second conveyor means has a second conveying direction opposite to the first conveying direction of the first conveyor means. The second conveyor means is provided for conveying the unwound flat products in a second imbricated product formation within which the edges which were trailing edges in the first imbricated product formation unwound from the storage coil or package form edges which are leading and uppermost edges.

By depositing the flat products released at the end of the first conveying path in imbricated product formation upon the second conveyor means arranged beneath the first conveying path and having an opposed conveying direction, an imbricated product formation is reconstituted upon the second conveyor means in which the flat products assume the same mutual orientation as before winding up. This alteration of the orientation of the flat products within their imbricated product formation unwound from the storage coil or package can therefore be performed with relatively simple means. At the end of the first conveying path the flat products lie with at least their leading edges and also with their upper and lower faces free which makes it simple to perform control operations, such as counting.

Due to the compressive pressure prevailing within the storage coil or package, in certain cases the printed products can adhere to one another. By separating or singling the printed products from one another at the end of the first conveying path, any possibly mutually adhering printed products are separated from one another. In the imbricated product formation conveyed away by the second conveyor means, each printed product is therefore united with the other printed products in a formation, yet the individual printed products are no longer attached to the neighboring printed products, which is a prerequisite for unhindered manipulation of the individual printed products.

This singling of any possibly mutually adhering printed products is further augmented when the printed products are brought out of contact with the respective subsequent printed product before reaching the end of the first conveying path, which is advantageously effected by acceleration of the individual printed products.

If the printed products overlap one another only in their edge regions, then the leading region of each printed product is advantageously deposited upon the preceding printed product before reaching the end of the first conveying path.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
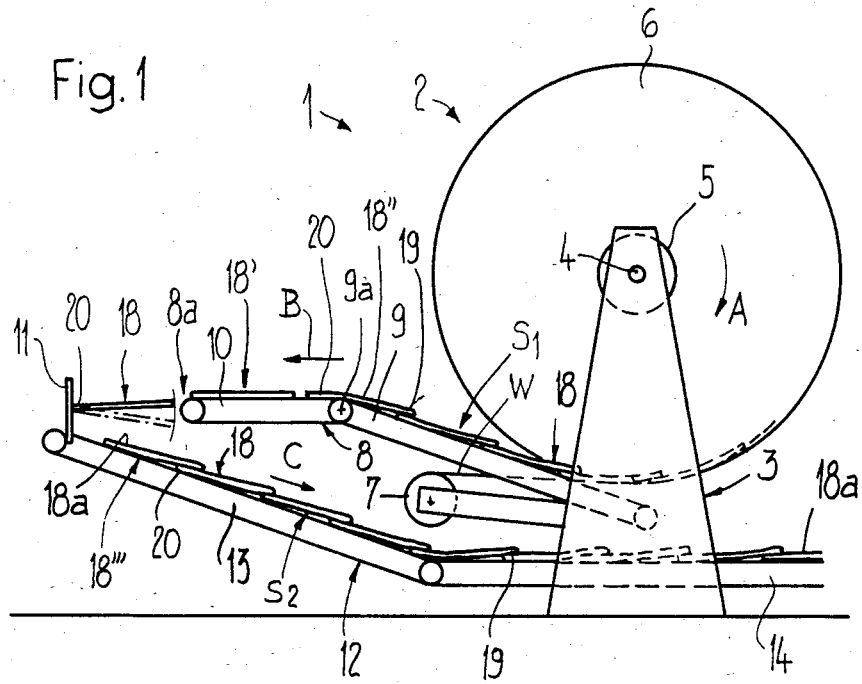
FIG. 1 schematically illustrates in elevation an apparatus for unwinding and conveying away printed products intermediately stored in a storage coil or package in imbricated product formation.

Describing now the drawings, it is to be understood that to simplify the showing thereof only enough of the structure of the apparatus for processing substantially flat products, especially printed products, unwound from a storage coil or product package has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the inventive method as hereinbefore described will be seen to comprise an unwinding station 1 in which a storage unit 2 is arranged. The latter corresponds in its construction and also in its operation to the winding up and storage unit described in the German Patent Publication No. 3,236,866 and the corresponding British Patent Publication No. 2,107,681, both corresponding to the commonly assigned, copending U.S. Pat. No. application Ser. No. 06/432,557, filed Oct. 4, 1982.

This storage unit 2 comprises a mobile frame or support 3 in the form of a bearing standard in which the shaft 4 of a cylindrical winding drum or core 5 is rotatably journalled. Printed products 18 in imbricated product formation are wound up upon this winding drum or core 5 in known manner to form a storage coil or wound package 6. A supply roll 7 for a winding band or strap W is rotatably journalled in the frame or support 3. The winding band or strap W is connected with the winding drum or core 5 and is arranged between the individual coil layers formed by the printed products 18.

A first conveyor device or means 8 is arranged beneath the winding drum or core 5 for conveying the unwound imbricated product formation $S_1$ away in the direction of the arrow B. This first conveyor means 8 comprises a first belt conveyor 9 constructed as a balance or rocker arm pivotably arranged about the axis 9*a* and pressed against the product coil or package 6 by not particularly shown but known suitable means. A second belt conveyor 10 follows this belt conveyor 9 and has a greater conveying speed than the belt conveyor 9.

At a distance from an outer end 8*a* of the first conveyor means 8, a stop or abutment 11 is arranged in the conveying path. A second conveyor device or means 12 is arranged beneath this stop 11 and therefore also beneath the first conveyor device 8. The conveying direction C of the second conveyor device 12 is opposed to the conveying direction B of the first conveyor device 8. This second conveyor device 12 comprises a first belt conveyor 13 which is inclined to the horizontal and extends rearwardly beyond the end 8*a* of the first conveyor device 8. A further belt conveyor belt 14 follows this belt conveyor 13.

Figure 2:
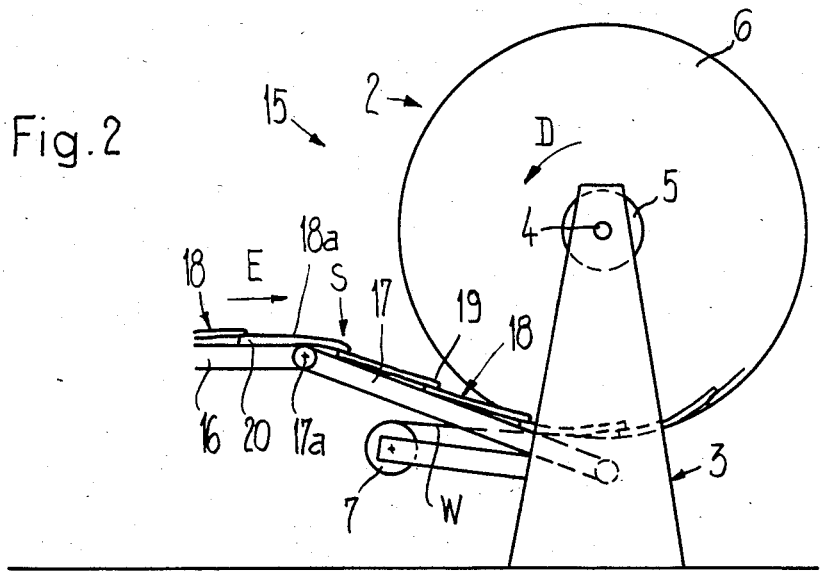
FIG. 2 schematically shows in elevation an apparatus for forming a storage coil.

For the sake of completeness, a winding up station 15 with a storage unit 2 is illustrated in FIG. 2. In this winding up station 15 an imbricated product formation S is wound up in known manner upon the winding drum or core 5 of the storage unit 2 together with a winding band or strap W. The imbricated product formation S to be wound up is delivered by an only partially illustrated belt conveyor 16. A further belt conveyor 17 constructed as a balance or rocker arm follows the belt conveyor 16. The belt conveyor 17 is pivotably journalled about its axis 17*a* and is pressed against the storage coil 6 by not particularly shown suitable known pressing means. The conveying direction of both belt conveyors 16 and 17 is designated with the reference character E.

The winding of the imbricated product formation S (FIG. 2) and the unwinding of the imbricated product formation $S_1$ (FIG. 1) from the winding drum or core 5, is performed in the manner described in the previously mentioned German Patent Publication No. 3,236,866 and the corresponding British Patent Publication No. 2,107,681, both corresponding to the U.S. patent application Ser. No. 06/432,557.

As can be seen from FIG. 2, each printed product 18 in the imbricated product formation S to be wound up overlies the preceding printed product 18. This means that the leading edge 19 of each printed product 18, which is usually the folded edge, lies upon the upper side or face of the imbricated product formation S and is therefore adjacent to the winding drum or core 5, respectively to the outer coil layer of the storage coil 6 forming thereupon. The trailing edge 20 of each printed product 18 is overlapped by the subsequent printed product 18. As can also be seen in FIG. 2, the printed products 18 overlap only in their edge regions. When winding up the imbricated product formation S, the storage unit 2 rotates in the direction of the arrow D.

In order to unwind the imbricated product formation $S_1$, the band supply roll 7 is driven. The winding drum or core 5 rotating in the direction of the arrow A (FIG. 1) is gently braked, as has been explained in the previously mentioned patent publications and application. As can be seen from FIG. 1, the printed products 18 within the imbricated product formation $S_1$ unwound from the coil 6 and deposited upon the belt conveyor 9 now have a different orientation with respect to their direction of travel than before winding up i.e. the prior leading edges 19 now are trailing edges.

In the unwound imbricated product formation $S_1$, each printed product 18 overlies the subsequent printed product 18 such that the leading edge 20, which formed the trailing edge in the original imbricated product formation S, lies upon the lower side or face of the imbricated product formation $S_1$. Now as soon as the printed products 18 arrive in the region of the faster moving belt conveyor 10, the printed products 18 are accelerated by this belt conveyor 10 and separated or singled, as is represented in FIG. 1 by the printed product designated with the reference character 18'. This acceleration of the individual printed products 18 draws them off from above the subsequent printed product 18' and therefore separates or singles them.

The printed products thus separated and singled from the imbricated product formation in this manner are now moved toward the stop or abutment 11 arranged in the conveying path of the printed products 18 conveyed by the first conveying device 8 and situated at a distance from the end **8*a* of the first conveyor device 8. This distance corresponds to at least the dimension of the printed products 18** in the conveying direction B.

After impingement of the printed products 18 against the stop 11, the printed products 18 fall downward and are deposited upon a preceding or leading printed product 18''' previously deposited upon the belt conveyor 13, respectively upon the formation of printed products 18 already deposited thereupon. The printed products 18 lying upon the belt conveyors 13 and 14 are conveyed away in the counter-direction C.

This transport at an appropriate speed in the counter-direction C has the result that the printed products 18 leaving the belt conveyor 10 and falling downward are deposited upon the belt conveyor 13 situated therebeneath in a reconstituted imbricated product formation, thus forming a new imbricated product formation $S_2$ in which each printed product 18 overlies the preceding or leading printed product 18 just as in the originally arriving imbricated product formation S (cf. FIG. 2). In the newly formed imbricated product formation $S_2$ the leading edges 19 of the printed products 18 therefore again lie upon the upper side or face of the imbricated product formation $S_2$ and are formed by the same edge as in the original imbricated product formation S.

The printed products 18 therefore assume the same mutual orientation in the newly formed imbricated product formation $S_2$ as in the original imbricated product formation S before winding up, which also means that the same sides **18*a* of the printed products 18** lie on the upper face of both imbricated product formations S and $S_2$.

The newly formed imbricated product formation $S_2$ can now be conducted to a suitable processing station in which the printed products 18 can be processed in the same manner as would printed products supplied directly to this processing station without any previous intermediate storage in a wound coil or package.

Figure 3:
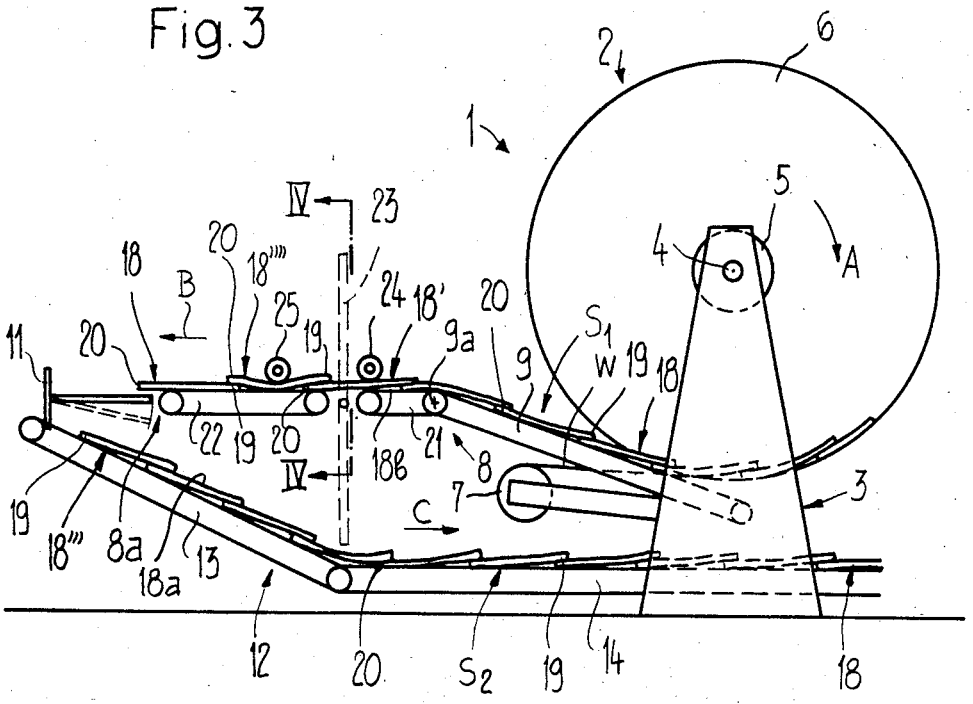
FIG. 3 schematically illustrates in elevation a further embodiment of an apparatus for unwinding and conveying away printed products intermediately stored in a storage coil or package in imbricated product formation.
Figure 4:
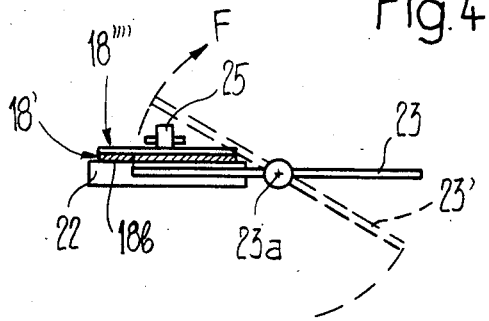
FIG. 4 schematically illustrates a section taken along the line IV—IV in FIG. 3.

The alternate embodiment illustrated in FIGS. 3 and 4 is especially suited to altering the orientation of the printed products within the imbricated product formation in formations in which the printed products only overlap in their edge regions. The apparatus according to FIG. 3 largely correspond, to that shown in FIG. 1. Therefore, the same reference characters are generally employed for corresponding elements in FIGS. 1 and 3. In the following only the differences between the two embodiments will be explained in more detail.

As can be seen in FIG. 3, the first conveyor device or means 8 comprises two belt conveyors 21 and 22 arranged subsequent to the belt conveyor 9 and driven at the same conveying speed as the belt conveyor 9. An entrainment member or rod 23 is arranged in the region of the belt conveyors 21 and 22 and which is driven to continuously rotate in the direction of the arrow F (FIG. 4) about an axis **23*a* extending substantially parallel to the conveying direction B of the belt conveyors 21 and 22. This rotational axis 23*a* is also positioned laterally adjacent the belt conveyors 21 and 22. The path of motion of the entrainment member or rod 23 extends substantially at right angles to the direction of motion or conveying direction B of the printed products 18 and between the belt conveyors 21 and 22. As can be seen from FIG. 4, the entrainment member or rod 23 crosses or traverses the path of motion of the printed products 18 during its revolving motion, especially its upward sweep. During this upward sweep, the entrainment member or rod 23 passes from a substantially horizontal position extending beneath the path of motion of the printed products 18 through such path of motion into a sloping position 23' shown in dotted line in FIG. 4 where the part of the entrainment member 23 shown to the left of the rotational axis 23*a* in FIG. 4 is situated above the path of motion of the printed products 18**.

Rollers 24 and 25 are arranged at both sides of the entrainment member or rod 23 and cooperate with the belt conveyors 21 and 22 and form together with these conveyors a gap through which the printed products 18 must travel. The printed products 18 are prevented from lifting from the belt conveyors 21 and 22 by these rollers 24 and 25 when the entrainment member or rod 23 acts upon the printed products 18 in a manner to be described below.

As can readily be seen from FIGS. 3 and 4, the rotating entrainment member or rod 23 moves during its rotary motion toward the lower side or face **18*b* of the printed product 18 situated above the interstice or gap between the two belt conveyors 21 and 22. This particular printed product 18' is lifted upward during the further motion of the entrainment member or rod 23. Since this printed product 18' is held in its rearward region between the roller 24 and the belt conveyor 21, the printed product 18' is lifted in the region of its leading edge 20 above the trailing edge 19 of the preceding printed product 18'''' and subsequently deposited upon this preceding printed product 18'''' as soon as the entrainment member or rod 23 no longer engages this printed product 18'. During this process, the preceding or leading printed product 18'''' is prevented from fully lifting off the belt conveyor 22 by the roller 25. Consequently, the entrainment member or rod 23 causes an inversion or re-layering in the imbrication of the printed products 18 within the unwound imbricated product formation $S_1$ in which the leading edge 20 on the under side or face of the formation after unwinding is brought to the upper side or face of the imbricated product formation $S_1$ as was just explained in relation to the printed product 18''''**.

The printed products 18 still remaining in imbricated product formation after this re-layering or inversion of imbrication are conveyed against the stop or abutment 11 just as in the embodiment according to FIG. 1. After impingement against such stop 11, the printed products 18 fall downward and are deposited upon the preceding or leading printed product 18'''. Since each printed product 18 is now overlapped by the subsequent printed product after this inversion of imbrication, the separation or singling of each printed product 18 out of the unwound imbricated product formation $S_1$ at the end of the conveying path defined by the first conveyor device 8 as well as its free fall downward are not hindered by any other printed product 18.

A new imbricated product formation $S_2$ is formed upon the belt conveyor 13 as was described in relation to FIG. 1 and which corresponds to the originally arriving imbricated product formation S (cf. FIG. 2) in relation to the mutual orientation of the printed products 18.

In both embodiments of the invention an imbricated product formation $S_2$ is obtained with relatively simple means and without repeated winding up of the imbricated product formation $S_1$ unwound from the storage coil or package 6. The imbricated product formation $S_1$ thus obtained corresponds to the original imbricated product formation S and can be delivered directly to processing stations.

Although the invention has been explained above in relation to imbricated product formations in which the printed products 18 overlap only in their edge regions, i.e. only slightly, it is also possible to process imbricated product formations in which the printed products mutually overlap to a greater extent than only in the edge regions in the manner described and, in particular, by means of the appartus described with reference to FIG. 1.

While there are shown and described present preferred embodiments of the invention, it is to be distinctly understood that the invention is not limited thereto, but may be otherwise variously embodied and practiced within the scope of the following claims. Accordingly,

What is claimed is:

1. A method for processing substantially flat products, especially printed products, comprising the steps of:

unwinding said flat products from a storage coil in imbricated product formation;

conveying said unwound flat products in imbricated product formation along a first conveying path in a first conveying direction;

depositing individual ones of said flat products at an end of said first conveying path in imbricated product formation upon preceding ones of said unwound flat products which are moving in a second conveying direction substantially opposite to said first conveying direction along a conveying path arranged beneath said first conveying path; and bringing each of said unwound flat products out or imbricated product formation with subsequent ones of said flat products before said end of said first conveying path.

2. The method as defined in claim 1, wherein:

said flat products are individually accelerated and thereby separated from subsequent ones of said flat products.

3. The method as defined in claim 1, comprising the further steps of:

conveying said flat products along said first conveying path against a stop means arranged in said first conveying path;

causing each of said flat products to fall downward after contacting said stop means; and depositing each of said flat products upon a preceding one of said flat products.

4. An apparatus for processing substantially flat products, especially printed products, unwound from a storage coil in imbricated product formation, comprising:

first conveyor means for conveying said unwound flat products in a first conveying direction in a first imbricated product formation;

said flat products having edges which are trailing edges within said first imbricated product formation;

second conveyor means arranged beneath said first conveyor means for taking over said flat products individually from said first conveyor means;

said second conveyor means having a second conveying direction opposite to said first conveying direction of said first conveyor means;

said second conveyor means serving for conveying said flat products in a second imbricated product formation within which said trailing edges of the first imbricated product formation form edges which are leading and uppermost edges in the second imbricated product formation; and means situated in the region of said first conveyor means for separting each of said flat products from a subsequent one of said flat products.

5. The apparatus as defined in claim 4, wherein:

said first conveyor means has an end; and said second conveyor means extends beyond said end of said first conveyor means in a direction opposite to said second conveying direction.

6. The apparatus as defined in claim 4, further including:

stop means for said flat products;

said first conveyor means having an end and defining a first conveying path extending in said first conveying direction;

said stop means being arranged in said first conveying path in spaced relationship to said end of said first conveyor means and above said second conveyor means; and said stop means being arranged such that each of said flat products conveyed by said first conveyor means impinges against said stop means and falls downward and is deposited upon said second conveyor means.

7. The apparatus as defined in claim 4, further including:

stop means for said flat products;

said first conveyor means having an end and defining a first conveying path extending in said first conveying direction;

said stop means being arranged in said first conveying path in spaced relationship to said end of said first conveyor means and above said second conveyor means; and said stop means being arranged such that each of said flat products conveyed by said first conveyor means impinges against said stop means and falls downward and overlays a preceding one of said flat products.

8. The apparatus as defined in claim 4, wherein:

said separating means comprises an acceleration device for accelerating each of said flat products.

9. The apparatus as defined in claim 8, wherein:

said first conveyor means comprises first and second conveyors;

said first conveyor having a predetermined conveying speed; and said acceleration device comprising said second conveyor of said first conveyor means and having a conveying speed greater than said first conveying speed of said first conveyor and arranged subsequent to said first conveyor.

10. The apparatus as defined in claim 4, further including:

means provided in the region of said first conveyor means for acting upon said flat products of the first imbricated product formation;

each of said flat products having a region which is a leading region within said first imbricated product formation; and said means for acting upon the flat products of the first imbricated product formation being provided for depositing said leading regions of each of said flat products upon a preceding flat product.

11. An apparatus for processing substantially flat products, especially printed products, unwound from a storage coil in imbricated product formation, comprising:

first conveyor means for conveying said unwound flat products in a first conveying direction in a first imbricated product formation;

said flat products having edges which are trailing edges within said first imbricated product formation;

second conveyor means arranged beneath said first conveyor means for taking over said flat products individually from said first conveyor means;

said second conveyor means having a second conveying direction opposite to said first conveying direction of said first conveyor means;

said second conveyor means serving for conveying said flat products in a second imbricated product formation within which said trailing edges of the first imbricated product formation form edges which are leading and uppermost edges in the second imbricated product formation;

means provided in the region of said first conveyor means for acting upon said flat products of the first imbricated product formation;

each of said flat products having a region which is a leading region within said first imbricated product formation;

said means for acting upon the flat products of the first imbricated product formation being provided for depositing said leading regions of each of said flat products upon a preceding flat product;

said acting means comprising an entrainment member for lifting said leading region of each of said flat products over a trailing region of a preceding one of said flat products; and said entrainment member traversing said first conveying path upwardly from an underside thereof.

12. The apparatus as defined in claim 11, further including:

means associated with said entrainment member for holding down one of said flat products situated in an operative region of said entrainment member as well as for holding down a preceding one of said flat products.

13. A method for processing substantially flat products, especially printed products, comprising the steps of:

unwinding said flat products from a storage coil in imbricated product formation;

conveying said unwound flat products with trailing edges thereof on an underside of said imbricated product formation along a first conveying path in a first conveying direction;

depositing individual ones of said flat products at an end of said first conveying path in imbricated product formation upon preceding ones of said unwound flat products which are moving in a second conveying direction substantially opposite to said first conveying direction along a conveying path arranged beneath said first conveying path; and depositing a leading region of each of said flat products upon a preceding one of said flat products before said end of said first conveying path.

14. The method as defined in claim 13, comprising the further steps of:

conveying said flat products along said first conveying path against a stop means arranged in said first conveying path;

causing each of said flat products to fall downward after contracting said stop means; and depositing each of said flat products upon a preceding one of said flat products.

15. An apparatus for processing substantially flat products, especially printed products, unwound from a storage coil in imbricated product formation, comprising:

first conveyor means for conveying said unwound flat products in a first conveying direction in a first imbricated product formation;

said flat products having edges which are trailing edges within said first imbricated product formation;

second conveyor means arranged beneath said first conveyor means for taking over said flat products individually from said first conveyor means;

said second conveyor means having a second conveying direction opposite to said first conveying direction of said first conveyor means;

said second conveyor means serving for conveying said flat products in a second imbricated product formation within which said trailing edges of the first imbricated product formation form edges which are leading and uppermost edges in the second imbricated product formation;

means provided in the region of said first conveyor means for acting upon said flat products of the first imbricated product formation;

each of said flat products having a region which is a leading region within said first imbricated product formation; and said means for acting upon the flat products of the first imbricated product formation being provided for depositing said leading regions of each of said flat products upon a preceding flat product.

16. The apparatus as defined in claim 15, wherein:

said first conveyor means has an end; and said second conveyor means extending beyond said end of said first conveyor means in a direction opposite to said second conveying direction.

17. The apparatus as defined in claim 15, further including:

stop means for said flat products;

said first conveyor means having an end and defining a first conveying path extending in said first conveying direction;

said stop means being arranged in said first conveying path in spaced relationship to said end of said first conveyor means and above said second conveyor means; and said stop means being arranged such that each of said flat products conveyed by said first conveyor means impinges against said stop means and falls downward and is deposited upon said second conveyor means.

18. The apparatus as defined in claim 15, further including:

stop means for said flat products;

said first conveyor means having an end and defining a first conveying path extending in said first conveying direction;

said stop means being arranged in said first conveying path in spaced relationship to said end of said first conveyor means and above said second conveyor means; and said stop means being arranged such that each of said flat products conveyed by said first conveyor means impinges against said stop means and falls downward and overlays a preceding one of said flat products.

* * * * *